US012736299B1

(12) United States Patent
Walsh

(10) Patent No.: US 12,736,299 B1
(45) Date of Patent: Sep. 15, 2026

(54) VALVE ASSEMBLY FOR A PROJECTILE LAUNCHING SYSTEM

(71) Applicant: Aiden Walsh, Urbana, IL (US)

(72) Inventor: Aiden Walsh, Urbana, IL (US)

( * ) Notice: Subject to any disclaimer, the term of this patent is extended or adjusted under 35 U.S.C. 154(b) by 107 days.

(21) Appl. No.: 18/599,782

(22) Filed: Mar. 8, 2024

Related U.S. Application Data

(60) Provisional application No. 63/450,897, filed on Mar. 8, 2023.

(51) Int. Cl.
*F41B 11/723* (2013.01)

(52) U.S. Cl.
CPC ..... *F41B 11/723* (2013.01)

(58) Field of Classification Search
CPC ..... F41B 11/72; F41B 11/721; F41B 11/722; F41B 11/723; F41B 11/80; F41B 11/60; F41B 11/62
See application file for complete search history.

(56) References Cited

U.S. PATENT DOCUMENTS 5,613,483 A * 3/1997 Lukas ..... F41B 11/724 124/75
5,778,868 A * 7/1998 Shepherd ..... F41B 11/52 124/76
6,889,681 B1 * 5/2005 Alexander ..... F41B 11/724 124/72
8,033,276 B1 * 10/2011 Gabrel ..... F41B 11/723 124/75
8,671,928 B2 3/2014 Hague et al.
9,033,306 B2 * 5/2015 Kunau ..... B60C 25/145 157/1.1
10,401,121 B2 9/2019 Hague et al.
10,598,461 B2 * 3/2020 Lort ..... F41B 11/73
10,914,545 B2 2/2021 Masse
2016/0033230 A1 * 2/2016 Lort ..... F41B 11/723 124/77
2018/0180377 A1 * 6/2018 Lort ..... F41B 11/62

OTHER PUBLICATIONS

Maker Classifications and Animations <URL:https://www.zdspb.com/tech/misc/animations.html> Accessed on internet Apr. 9, 2024 (4 pages).

* cited by examiner

*Primary Examiner* — Benjamin P Lee
(74) *Attorney, Agent, or Firm* — Mitchell Hamline IP Clinic

(57) ABSTRACT

A valve assembly may include a housing assembly with an expansion chamber. The assembly may also include a bolt movably positioned in the expansion chamber with a longitudinal through hole and a radially disposed through hole. The bolt may have first, second, and third positions. In first position and third positions, the expansion chamber may be sealed from the longitudinal through hole and the radially disposed through hole. In the second position, the expansion chamber may be fluidly coupled to these holes. The assembly may include an orifice to fluidly couple the expansion chamber to a first bolt surface. The assembly may include a stem that sits within the longitudinal through hole of the bolt when the bolt is in the first position. The assembly may also include a sealing member to selectively seal or fluidly couple the expansion chamber and the orifice.

19 Claims, 12 Drawing Sheets

VALVE ASSEMBLY FOR A PROJECTILE LAUNCHING SYSTEM

CROSS-REFERENCE TO RELATED APPLICATIONS

The present application claims priority to U.S. Provisional Application No. 63/450,897 filed on Mar. 8, 2023 and entitled Valve Assembly for a Projectile Launching System, the content of which is hereby incorporated by reference herein in its entirety.

TECHNOLOGICAL FIELD

The present application relates to a valve assembly for selectively producing an air jet. More particularly, the present application relates to a valve assembly for selectively producing an air jet at a particular and/or selected location by moving a nozzle into place at the time of producing the air jet. Still more particularly, the present application relates to a valve assembly for selectively producing an air jet such as may be used in a projectile launching system such as air soft guns, dart guns, or other guns or launching devices.

BACKGROUND

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Airsoft guns and other projectile launching systems or devices can include internal valve assemblies that control the flow of air from an air source and allow for selectively releasing a burst of air or other gas to launch a projectile from the device. Existing designs use the high performance, complex solenoids to achieve the levels of performance desired by the consumer. However, solenoids can be relatively complex devices and can be expensive to manufacture, which may often drive up the overall cost of the product and can reduce serviceability. There is therefore a need for improved valve assemblies for projectile launching systems that are inexpensive, reliable, and are easy to maintain.

SUMMARY OF THE INVENTION

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

In one or more examples, a valve assembly may include a housing assembly and an expansion chamber configured to receive a pressurized gas source and positioned inside of the housing assembly. The valve assembly may also include a bolt with a first bolt end and a second bolt end, wherein the bolt is slidably positioned in at least part of the expansion chamber and movable from a first position to a second position relative to the housing assembly. The bolt may also be movable from the second position to a third position relative to the housing assembly. The bolt may also have a longitudinal through hole extending from the first bolt end to the second bolt end. The valve assembly may also include at least one radially disposed through hole extending from a radially outer bolt surface to the longitudinal through hole, wherein the translation of the bolt relative to the housing assembly from the first position to the second position fluidly couples the expansion chamber with the at least one radially disposed through hole. The translation of the bolt relative to the housing assembly from the second position to the third position may fluidly seal the expansion chamber from the at least one radially disposed through hole. The valve assembly may also include an orifice configured to allow a passage of a gas from the expansion chamber to a first bolt surface. The valve assembly may also include a stem coupled to the housing assembly, wherein the stem is configured to at least partially sit within the longitudinal through hole of the bolt when the bolt is in the first position. The valve assembly may also include a sealing member, wherein the sealing member is configured to seal the expansion chamber from the orifice. The sealing member may have a first sealing member position sealing the orifice from the expansion chamber. The sealing member may also have a second sealing member position fluidly coupling the orifice and the expansion chamber.

In one or more examples, a valve assembly may include a housing assembly and an expansion chamber configured to receive a pressurized gas source and positioned inside of the housing assembly. The valve assembly may also include a bolt with a first bolt end and a second bolt end. The first bolt end may define a first bolt surface, wherein the bolt is slidably positioned in at least part of the expansion chamber and movable from a first position to a second position relative to the housing assembly. The bolt may also have a longitudinal through hole extending from the first bolt end to the second bolt end. The bolt may also include at least one radially disposed through hole extending from a radially outer bolt surface to the longitudinal through hole, wherein the translation of the bolt relative to the housing assembly from the first position to the second position fluidly couples the expansion chamber with the at least one radially disposed through hole. The valve assembly may also include an orifice configured to allow a passage of a gas from the expansion chamber to the first bolt surface. The valve assembly may also include a stem coupled to the housing assembly, wherein the stem is configured to at least partially sit within the longitudinal through hole of the bolt when the bolt is in the first position. The valve assembly may also include a sealing member having a first sealing member position sealing the orifice from the expansion chamber and a second sealing member position fluidly coupling the orifice and the expansion chamber.

In one or more examples, a valve assembly may include a housing defining an expansion chamber and having a central bore at a proximal end for receiving a first end of a bolt and a bolt bore at a distal end for receiving a second end of the bolt. The housing may also define an orifice arranged at a proximal end of the central bore providing fluid communication between a proximal portion of the central bore and the expansion chamber. The mentioned bolt may be arranged in the housing and configured to articulate within the central bore and the bolt bore from a first position to a second position. The bolt may include a longitudinal through hole extending throughout a length thereof. The bolt may also include a first seal arranged on the first end and configured for sealingly engaging the central bore and a second seal arranged on the second end and configured for sealingly engaging the bolt bore. The bolt may also include a plurality of radially disposed through holes extending therethrough to the longitudinal through hole within the bolt. The valve assembly may also include a seal configured to selectively seal the orifice.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1A:
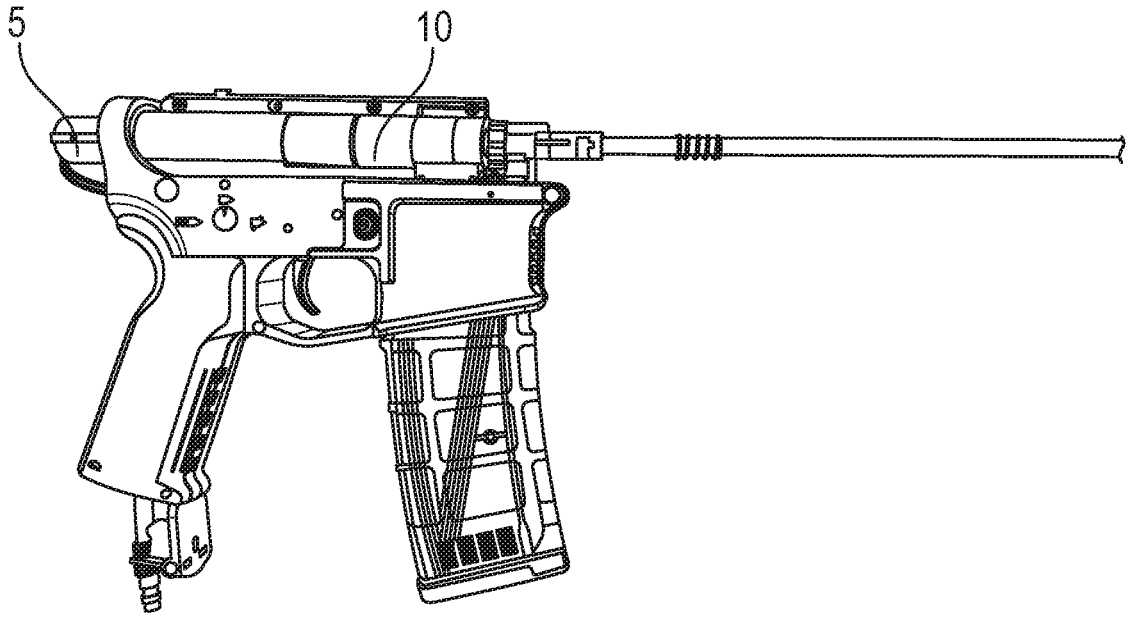
FIG. 1A is a perspective view of a projectile launching system in the form of an airsoft gun having a valve assembly, according to one or more examples.

For the purposes of promoting an understanding of the principles of the present disclosure, reference will now be made to the examples illustrated in the drawings, and specific language will be used to describe the same. It will nevertheless be understood that no limitation of the scope of the invention is thereby intended.

The present disclosure, in one or more examples, relates to valve assemblies for projectile launching systems. For example, the valve assembly may be particularly well suited for use in an airsoft gun, dart gun, or other projectile launching system. In one or more examples, the valve assembly may be configured to launch BBs, pellets, toy darts, foam projectiles, or absorbent water beads. Other projectiles may also be launched by the projectile launching system. The particular valve assembly described herein may be manufactured relatively inexpensively, thus, reducing the cost to the end user. Moreover, the valve assembly may be very reliable and easy to maintain and does not require the use of a solenoid. That is, while a solenoid may be used, a less expensive mechanical actuator may also be used in conjunction with the valve assembly described. As such, the overall system may be more cost effective for the end user.

Figure 1B:
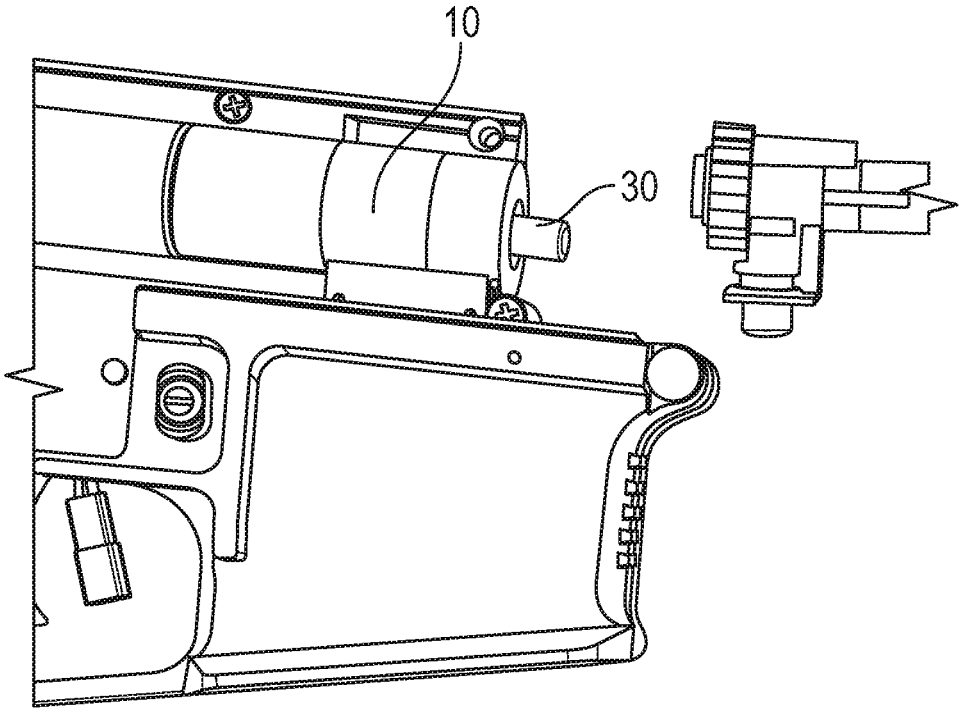
FIG. 1B is a close-up view of a distal end of the valve assembly with the valve assembly arranged in a projectile launching system.
Figure 2:
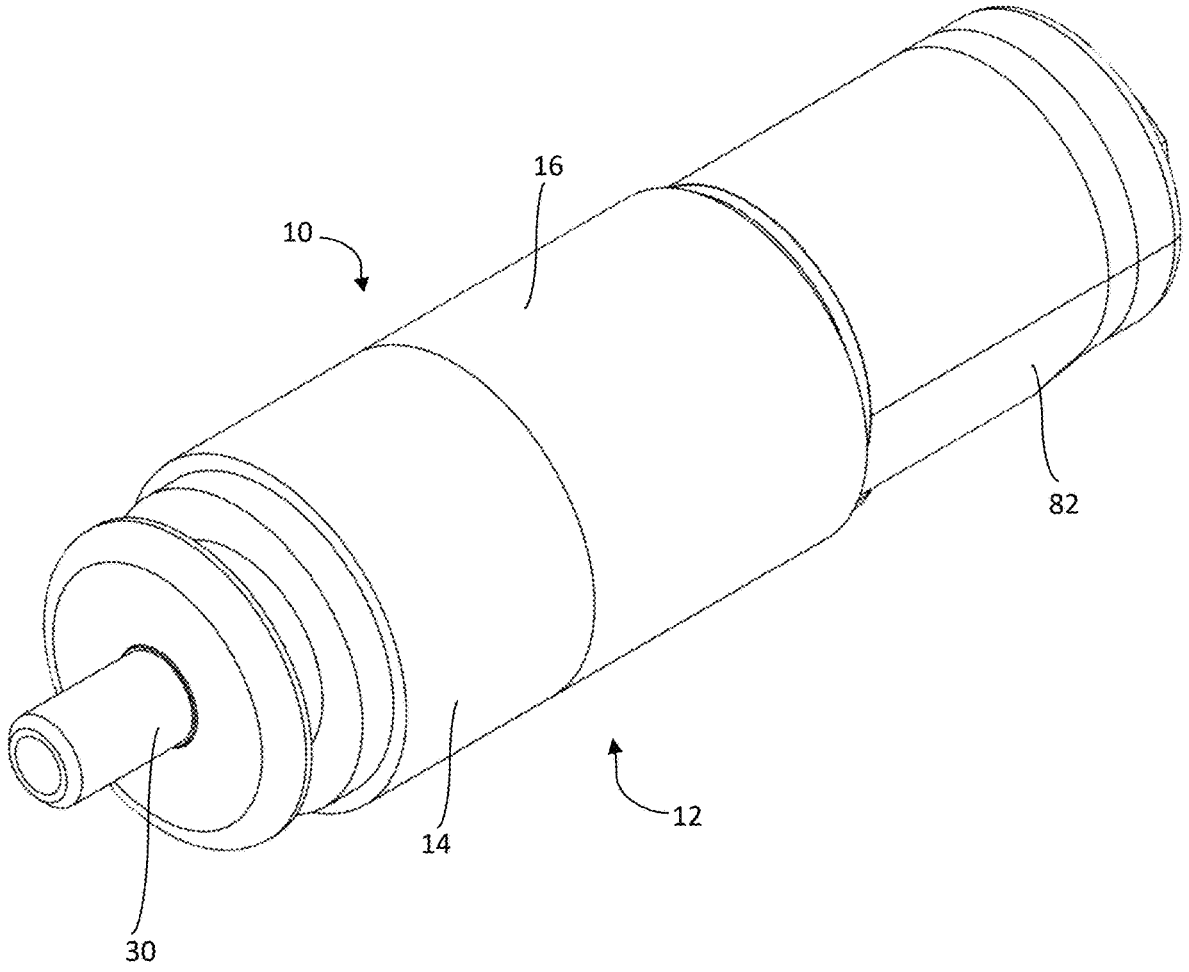
FIG. 2 is a top/front side perspective view of the valve assembly of the projectile launching system of FIG. 1.
Figure 3:
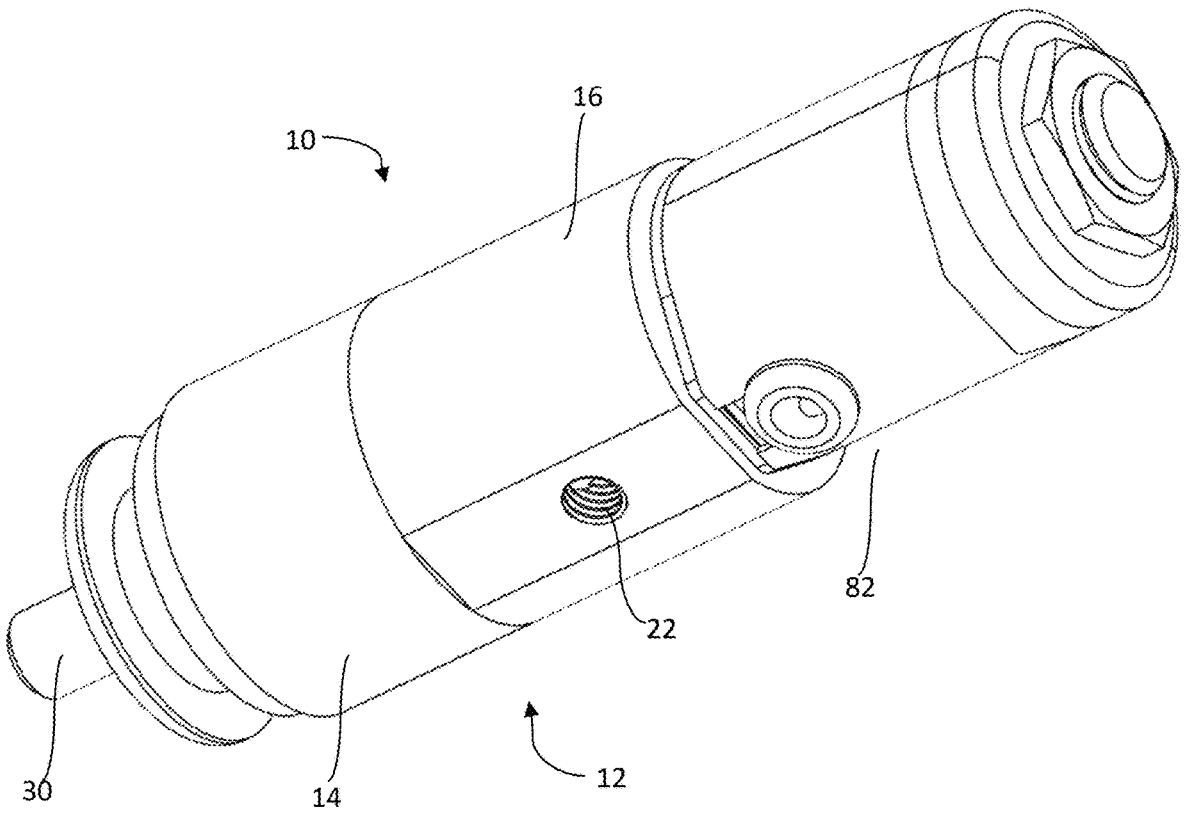
FIG. 3 is a bottom/rear side perspective view of the valve assembly of FIG. 2.
Figure 4:
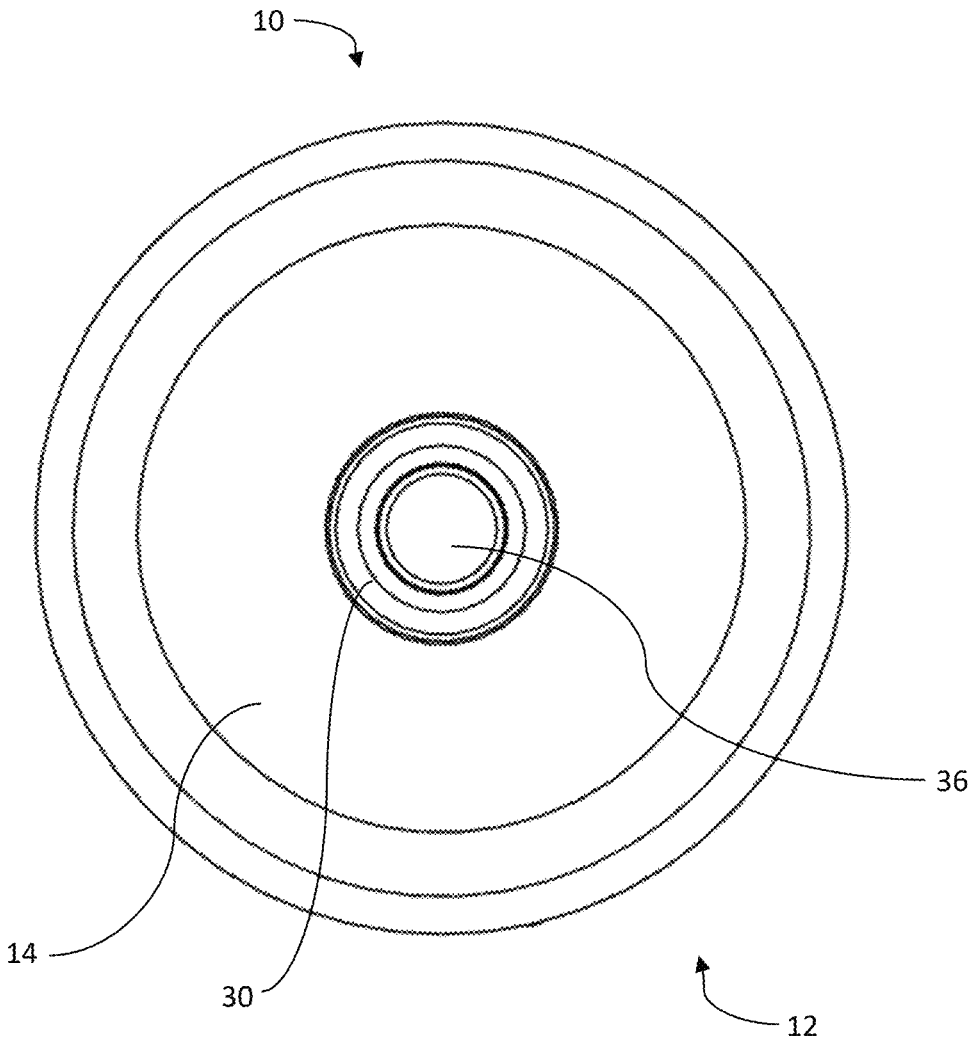
FIG. 4 is a front side view of the valve assembly of FIG. 2.
Figure 5:
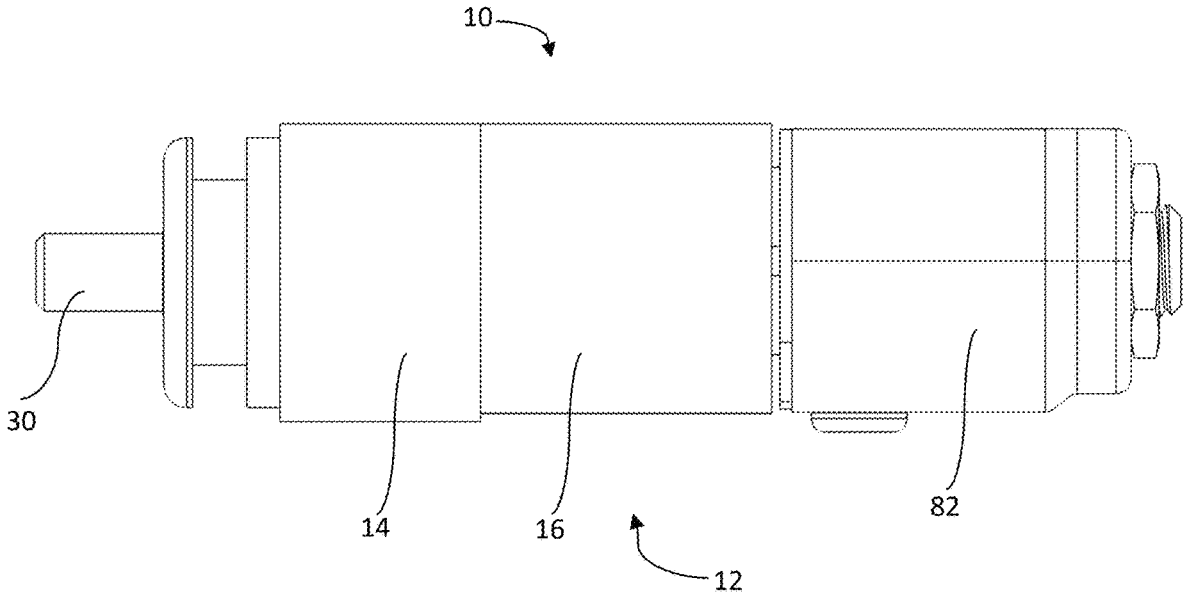
FIG. 5 is a right-side view of the valve assembly of FIG. 2.
Figure 6:
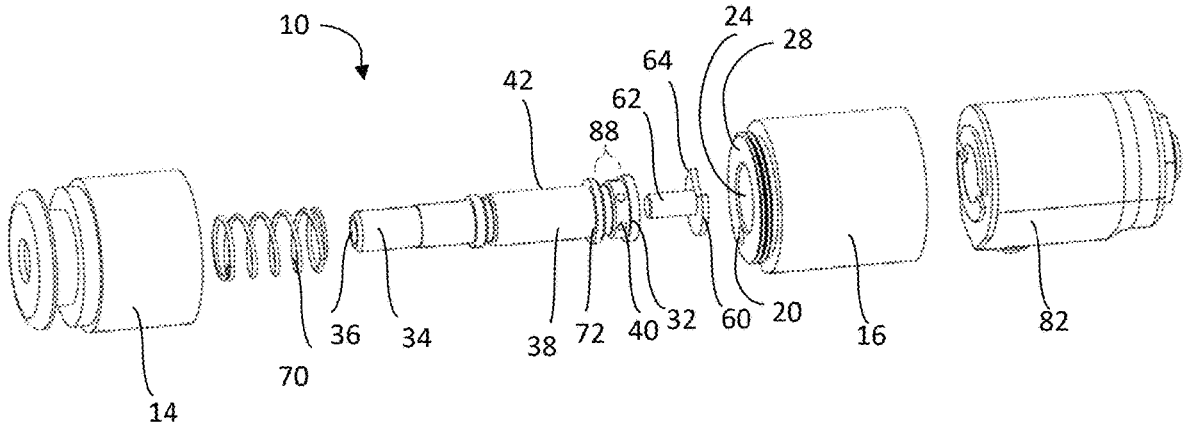
FIG. 6 is an exploded view of the valve assembly of FIG. 2.
Figure 7:
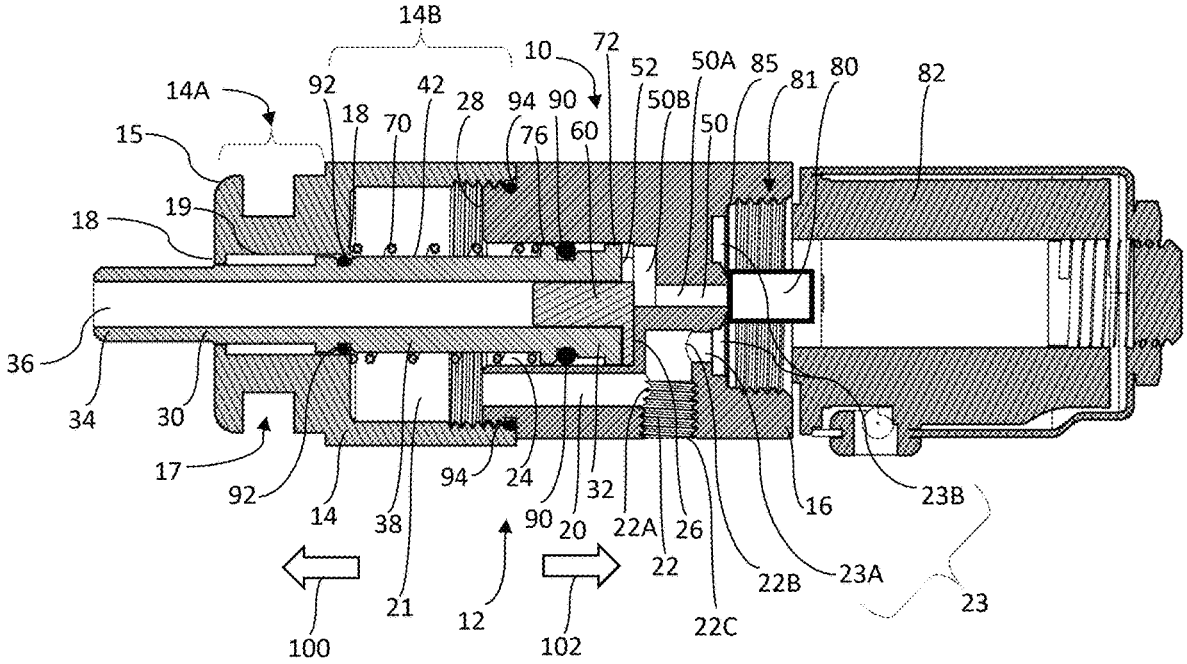
FIG. 7 is a cross-sectional right-side view of the valve assembly of FIG. 2 where the bolt is in a first position, the sealing member is in a first sealing member position, and the spring is in a neutral state.

As shown in FIGS. 1A and 1B, the valve assembly 10 may be configured for placement within or attachment to the projectile launching device or system 5. In addition, the valve assembly 10 may be configured to interface with an actuator and a pressurized gas source to leverage the pressurized gas to selectively advance a bolt 30 and release compressed air to drive a projectile. FIGS. 2-6 show the valve assembly 10 in isolation from the projectile launching device. As shown, the valve assembly may include a housing assembly 12 including a first body 14 and an intermediate body 16 with a bolt 30 arranged within the housing assembly 12 and extending out of a distal end thereof. The exploded view of the valve assembly 10 in FIG. 6 shows additional internal components of the valve assembly 10 including a side view of the mentioned bolt 30, a spring 70, and a stem 60. Moreover, and as shown in FIG. 7, the valve assembly may also include a sealing member 80. Each of these will be described in turn and primarily with reference to FIGS. 6 and 7. For purposes of reference, proximal may refer to aspects of the valve assembly that are closer to, for example, the user of the launching system 5 and distal may refer to thing that are further from the user. As an example, a user using the launching system 5 may hold onto the handle shown in FIG. 1 and direct the system away from them. As such, aspects of the valve assembly 10 that are closer to the handle may be proximal while aspects of the valve assembly that are further from the handle may be distal.

The shape, size, and configuration of the housing assembly 12 may provide for the valve assembly's ability to be placed within or attached to a projectile launching device or system 5. That is, the shape may be particularly suited for arrangement in a pocket or cavity within a body of an airsoft gun or other projectile launching device 5. As shown, the housing 12 may be a generally cylindrical housing and may include engagement features or other surface features adapted to engage the launching device or system 5. Other particulars of the housing assembly are included below in the discussion of the parts of the housing assembly 12. The housing assembly 12 may also provide for the valve assembly's ability to interface with an actuator 82 and a pressurized gas source by providing interfacing features for attachment and operable engagement of these devices. Moreover, the housing assembly 12 may house one or more of the working components of the valve assembly 10. As shown, the housing assembly 12 may include a first body 14 and an intermediate body 16.

The first body 14 may form a distal portion of the housing 12. The first body may include a distal end and a proximal end, and the proximal end may be coupled to the intermediate body 16. For example, the proximal end of the first body 14 may include threads that engage corresponding threads on a distal end of the intermediate body 16. In one or more examples, the threads on the first body 14 may be on an internal surface, but the threads may also be on an exterior surface. The first body 14 may be a generally cylindrical element with a generally circular outer surface. More particularly, the first body 14 may include a nose portion 14A and a proximal portion 14B.

The nose portion 14A of the first body 14 may have a circular outer surface defining a diameter and may include a rounded off edge 15 on the distal most portion thereof. Immediately adjacent and proximal to the distal most portion or relatively close to the distal most portion, the nose portion 14A may include an annular trough 17 having a depth extending inward from the outer surface and a length measured longitudinally along the housing 12. The annular trough 17 may cause the distal most portion of the nose portion to form an annular plate with a thickness. Proximal of the annular trough, the outer surface may extend further proximally to the proximal portion 14B of the outer surface of the first body 14.

The proximal portion 14B of the of the first body 14 may also have a circular outer surface defining a diameter slightly larger than the diameter of the nose portion 14A and defining a step and the intersection of the nose portion 14A and the proximal portion 14B. The outer surface of the proximal portion 14B may extend proximally, and substantially uninterrupted, from the step to the proximal end of the first body 14.

Within the first body 14, a bolt bore 19 may extend through the nose portion 14A and into the proximal portion 14B. The bolt bore may have an internal diameter adapted to receive the intermediate bolt body 38 of the bolt 30 in sealing engagement with an O-ring or seal 92 on the intermediate bolt body 38 of the bolt 30. The distal portion of the bolt bore 19 may include a necked down area or lip 18 with a smaller inner diameter sized and adapted to hold and/or stabilize the second bolt end 34 of the bolt 30. Proximal of the bolt bore 19 and within the proximal portion 14B of the first body 14, the bolt bore 19 may give way to a relatively large internal cavity or expansion chamber 21 within the first body 14. The expansion chamber 21 may extend proximally from the bolt bore 19 to the proximal end of the first body 14. The large cavity may define an inner surface of the proximal portion 14B of the first body 14. The inner surface may have the mentioned threads for engaging the intermediate body 16. In other examples, a necked down or narrower surface may be provided for such attachment. A groove and a seal 94 may be provided at the interface between the first body 14 and the intermediate body 16 to resist escape of gas from the expansion chamber 21 when the first body 14 and intermediate body 16 are assembled.

Turning now to the intermediate body 16, such may form the central portion of the valve assembly 10, may provide for attachment of the actuator 82 and the pressurized gas source, and may interface with the bolt 30 to selectively expose the projectile to bursts of air or gas. As shown, the intermediate body 16 may be a generally cylindrical element having a distal end and a proximal end and a generally circular outer surface. While a cylindrical element has been described, other shapes may be provided such as rectangular, square, oval, etc. The intermediate body 16 may include an engagement feature at the distal end for coupling to the first body 14. For example, threads may be provided on a necked down portion of the intermediate body 16 allowing the proximal end of the first body 14 to be threaded onto the intermediate body 16. The necked down portion may allow for the first body 14 and the intermediate body 16 to have a generally flush outer surface when connected. The intermediate body 16 may include a central bore 24, an actuator interface 81, and a pressurized gas interface 22. In addition, the intermediate body may include a system of fluid pathways for selectively exposing the central bore 24, and the proximal end of the bolt 30 therein, to gases supplied by the gas source and held by the expansion chamber 21. In one or more examples, the system of fluid pathways may include an auxiliary passage 20, a back passage 23, and an orifice 50.

Starting with the central bore 24, such may be configured for receiving a proximal portion of the bolt 30, for exposing the proximal end of the bolt to varying air pressures, and for guiding longitudinal movement of the bolt 30. The bore 24 may extend into the intermediate body 16 from a distal end surface 28 of the intermediate body 16 and along a longitudinal axis of the intermediate body 16. The bore 24 may have a depth extending through approximately ½ or approximately ¾ of the length of the intermediate body 16 or the depth may extend approximately ⅔ of the length of the intermediate body 16. Still other depths may be provided. In particular, in one or more examples, the depth of the central bore may be sufficient to fully contain the stem 60 and the first/second bolt lips 72/76 when the bolt 30 is fully seated in the central bore 24. The bore 24 may be axially aligned with a central axis of the intermediate body 16 and may include a distally facing bottom planar surface 26. In one or more examples, the opening in the distal end surface 28 of the intermediate body 16 is chamfered to allow ease of entry of bolt 30 into the cylindrical central bore 24.

The actuator interface 81 may be located on a proximal end of the intermediate body 16 and may provide for attachment of an actuator 82, such as an electrical solenoid, a mechanical actuator, or another type of actuator. The actuator interface 81 may include an interface bore in the proximal end of the intermediate body 16. The interface bore may extend distally into a proximal end of the intermediate body 16 such that the distal end of the interface bore intersects with the back passage 23 and the orifice 50. An annular shelf 85, configured to arrest the motion of the actuator when the actuator is connected to the actuator interface, may protrude from the distal end of the interface bore, creating a gap between the distal end of the actuator 82 and the back passage 23 and/or the orifice 50. A sealing element such as an O-ring or gasket, configured to prevent fluid from escaping through the interface bore, may be installed on the annular shelf 85. The interface bore may have threading or grooves along the inner surface to facilitate attachment of an actuator or the inner surface may be substantially smooth. Additionally, or alternatively, the actuator interface can include screw holes or bolt holes positioned radially around the perimeter of the interface bore on the proximal end of the intermediate body 16 to receive screws or bolts for securing the actuator to the proximal end of the intermediate body 16.

The pressurized gas interface 22 may provide for attachment of a pressurized gas source to the intermediate body 16 may also provide fluid communication to other aspects of the intermediate body 16. In some examples, the pressurized gas interface 22 includes a bore extending radially into a lateral side of the intermediate body 16 and having a longitudinal axis generally orthogonal to the longitudinal axis of the intermediate body 16. In some examples, the bore may be a cylindrical bore. Alternatively, other shapes not limited to rectangular, square, or oval may be provided. In some examples, the pressurized gas interface may include at least three apertures. For example, a first aperture 22A may be a distal facing aperture arranged along the length of the bore. In some examples, the first aperture 22A may fluidly couple the proximal end of the auxiliary passage 20 to the pressurized gas interface 22. A second aperture 22B may be arranged along the length of the bore. In some examples, the second aperture 22B may be a proximally facing aperture arranged near an inward most end of the bore. In some examples, the second aperture 22B may fluidly couple the pressurized gas interface 22 to the back passage 23. In some examples, a third aperture 22C may be arranged on an outer surface of the intermediate body 16 and may be the aperture that gives way to the bore from outside of the intermediate body 16. In some examples, threads may extend along an inner surface of the bore from the third aperture. In some examples, the threads may only extend a partial length of the bore. In some examples, the threads may be adapted to engage a nipple of a gas cylinder or a gas line. In some examples, the gas from an attached gas source may be fluidly coupled to the auxiliary passage and the back passage by flowing into the bore of the pressurized gas interface and through the first aperture and the second aperture, respectively. While the pressurized gas interface 22 has been shown as being positioned on the intermediate body 16, it may also be positioned on the first body 14 or another location may be provided.

As mentioned, the intermediate body 16 may include a system of fluid pathways including an auxiliary passage 20, a back passage 23, and an orifice 50. The auxiliary passage 20 may be configured for providing fluid communication between the gas interface 22 and the expansion chamber 21 as well as for providing fluid communication between the expansion chamber 21 and the back passage/orifice 23/50 via the gas interface 22. The auxiliary passage 20 may be positioned radially outward from the central bore 24. In one or more examples, the auxiliary passage 20 may have a round cross-section with a diameter the same as, smaller, or considerably smaller than the central bore 24. Still other cross-sections and sizes may be provided. This auxiliary passage 20 may extend proximally from the distal end surface 28 of the intermediate body 16, parallel to the central bore 24, to the gas interface 22. While a single auxiliary passage 20 has been shown, multiple auxiliary passages may be provided.

The back passage 23 may be configured to provide fluid communication between the gas interface 22 and/or auxiliary passage 20 to the orifice 50. As shown, the back passage may extend proximally from the gas interface 22 via aperture 22B toward and/or into the actuator interface 81. The back passage may include a proximally extending bore 23A that gives way to an annular recess 23B in a distal end of the actuator interface 81. The annular recess 23B may surround a nipple or other protrusion on the proximal end of the intermediate body 16 within the actuator interface 81. As such, the back passage 23 may allow fluid to flow directly from the gas interface 22 and/or from the expansion chamber 21 via the auxiliary passage 20 and the gas interface 22 to and within a proximal portion of the intermediate body and just outside the orifice 50. Where multiple auxiliary passages 20 are provided, an equal number of proximally extending bores 23A may be provided such that each auxiliary passage 20 is fluidly connected to the annular recess 23B.

It is to be appreciated that while the expansion chamber 21 has been described as being part of and arranged within the first body 14, in one or more examples, the expansion chamber 21 may include both the expansion chamber 21 and the auxiliary passage 20 or it may include all of the fluidly connected spaces between the expansion chamber 21 and the orifice 50 such as the expansion chamber 21 itself, the auxiliary passage 20, the bore of the pressurized gas interface 22 and the back passage 23. The expansion chamber 21 may also include a distal portion of the central bore 24 (e.g., the portion distal of the seal or seals 90). Accordingly, and in some examples, the expansion chamber 21 may at least be partially defined by the first body 14 and the intermediate body 16.

The orifice 50, as shown in FIG. 7, is configured to allow the passage of gas from the back passage 23 to the first bolt surface 52. The orifice may include a primary passage 50A and a radial passage 50B. The primary passage 50A may be configured to allow passage of gas from the back passage 23 to a region generally poised to act on the bolt 30 by way of the radial passage 50B. In one or more examples, the primary passage may be a through hole (i.e., void of material) extending distally from the back passage 23, through the nipple in the bottom of the actuator interface 81, and toward the central bore 24. The primary passage 50A may extend to and be in fluid communication with the radial passage 50B. The primary passage 50A may have a circular cross-section or a rectangular or other shaped cross-section may be provided. The primary passage 50A may be aligned along the longitudinal central axis of the intermediate body 16. Alternatively, the primary passage 50A may be offset laterally from the longitudinal axis. Moreover, the primary passage 50A might not be aligned with the longitudinal axis and may extend at an angle to the longitudinal axis.

The radial passage 50B may be configured to provide fluid access to the first bolt surface 52 of the bolt 30 by diverting the fluid flow around and/or through the stem 60. The radial passage may include a recess in a bottom of the central bore 24 that provides a gap between a proximal surface of the stem 60 and the intermediate body 16 so as to allow gas flow from the distal end of the primary passage 50B radially to an opening in the stem 60 to contact and/or act upon the first bolt surface 52 of the bolt 30. The radial passage may be a groove in a bottom of the central bore 24 or a circular, but offset recess in the bottom of the central bore 24 may be provided. Most any shape of recess may be provided and may be sized to be smaller than the bottom of the central bore 24 so as to hold the stem at a distance from the distal end of the primary passage 50A and allow gas to escape laterally to access the first bolt surface 52 of the bolt 30.

Having described the intermediate body 16 in detail, attention may be turned to the other aspects of the valve assembly 10 including the bolt 30, the spring 70, and the stem 60. The bolt 30 may be configured to slide within at least a portion of the housing assembly 12 in response to pressurized gas, facilitating the flow of pressurized gas through the bolt 30. The bolt 30 may be a generally cylindrical element having a distal end and a proximal end and a generally circular outer surface and a generally circular inner surface. In some examples, the outer surface includes regions characterized by distinct outer diameters. In some examples, the inner surface is characterized by a single inner diameter. In some examples, the bolt 30 may include a longitudinal through hole 36, a first bolt end 32 at the proximal end of the bolt 30, a second bolt end 34 at the distal end of the bolt 30, and an intermediate bolt body 38 characterized by a region between the first bolt end 32 and the second bolt end 34.

In some examples, the longitudinal through hole 36 is an aspect of bolt 30 configured to receive and direct pressurized air from a pressurized gas source. In some examples, the longitudinal through hole 36 is a generally cylindrical bore extending longitudinally from the proximal end of the bolt 30 to the distal end of the bolt 30. In some examples, the longitudinal through hole 36 may be selectively fluidly coupled with the central bore 24 of the intermediate body 16 when bolt 30 displaces longitudinally along the central bore in a distal direction. In such examples, pressurized air within the central bore 24 may flow into the longitudinal through hole 36 as described in more detail below. While the longitudinal through hole 36 has been described as a cylindrical bore, it may include a bottleneck or narrower region or a broadening region to control gas flow therethrough. These features may be used to restrict flow, increase flow, or otherwise control the flow depending on the desired nature of the air/gas get being provided.

In some examples, the first bolt end 32 is a region of bolt 30 that most directly interacts with the intermediate body 16 and is in fluid communication with the central bore 24. In some examples, the first bolt end 32 includes a first or rear bolt lip 72, a first bolt surface 52, a second or front bolt lip 76, and a main body 88. The first or rear bolt lip 72 may have a generally circular outer surface and an outer diameter similar to, but less than the diameter of the central bore 24. For example, in some examples, wherein the bolt 30 is longitudinally displaced such that it occupies at least a portion of the central bore 24, the outer surface of the first bolt lip 72 may contact an inner surface of the central bore 24. Turning now to the first bolt surface 52, it may form the proximal facing surface of the proximal or first bolt end 32 of bolt 30. In some examples, the first bolt surface 52 is an annular surface with an outer diameter equal to the outer diameter of the first bolt lip 72 and an inner diameter defined by the through hole 36. In some examples, the first bolt surface 52 may be in fluid communication with pressurized air flowing through the back passage 23 and orifice 50. The second or front bolt lip 76 may have a generally circular outer surface and an outer diameter equal to the outer diameter of the first bolt lip 72. In some examples, the second bolt lip 76 may have an outer diameter greater than the outer diameter of the intermediate bolt body 38 such that the outer surface of the intermediate bolt body 38 is perpendicular to a distal facing surface of the second bolt lip 76. In some examples, the distal facing surface contacts a biasing mechanism 70. In some examples, the biasing mechanism 70 may be a spring.

The main body 88 may include a region of the first bolt end 32 extending between the first bolt lip 72 and the second bolt lip 76. In some examples, the main body includes a generally circular outer surface (e.g., a radially outer bolt surface). In some examples, the main body has an outer diameter less than the outer diameter of both the first bolt lip 72 and the second bolt lip 76. In some examples, the main body includes at least one radially disposed through hole 40 (see FIG. 6). In some examples, the through hole 40 radially extends towards the radial center of the intermediate body 16. In some examples, the through hole 40 extends from the outer surface of the main body 88 to the longitudinal through hole 36 within the bolt 30. A plurality of through holes 40 may be provided that are spaced about the circumference of the main body 88. In some examples, the through holes 40 may be equally spaced about the circumference of the main body 88. While the through holes 40 have been described as extending radially, the holes 40 may also extend distally as they pass from outside the bolt and into the longitudinal through hole 36. That is, the through holes may extend radially and longitudinally as they pass through the wall of the bolt 30. This may help direct the gas passing through the through holes 40 in a distal direction as it enters the longitudinal through hole 36. The through holes 40 may be fluidly couple the longitudinal through hole 36 to the central bore 24. In some examples, the main body 88 includes a circumferential groove distal and/or proximal to the one or more through holes 40. In some examples, the circumferential groove is adjacent and proximal, or immediately proximal, to the second bolt lip 76. In some examples, the circumferential groove or a second circumferential groove is adjacent and distal, or immediately distal, to the first bolt lip 72. In some examples, a radial seal or seals 90 rests within the circumferential groove or grooves. In some examples, wherein the first bolt end 32 is longitudinally displaced such that the second bolt lip 76 is within the central bore 24, the radial seal 90 contacts the inner surface of the central bore 24 as to prevent fluid communication between the central bore and the expansion chamber 21 of the first body 14.

In some examples, the second bolt end 34 is a distal region of bolt 30. In some examples, the second bolt end 34 has a generally cylindrical outer surface. In some examples, the second bolt end 34 may have an outer diameter less than the outer diameter of the intermediate bolt body 38. In some examples, the outer diameter may be less than the diameter of the distal lip 18 of the first body 14. For example, where the bolt 30 is longitudinally displaced such that the first bolt end 32 advances along or through the intermediate body 16, the outer surface of the second bolt end 34 may extended distally past the distal lip 18 of the first body 14. In such examples, the outer surface of the second bolt end 34 may contact and/or sleevably engage the distal lip 18 of the first body 14. As shown, the second bolt end 34 may be arranged outside of the housing assembly 12 and may move further distally away from the housing assembly when the bolt 30 transitions to from a first position to a second position. However, it is to be appreciated that depending on the geometry of the housing 12, the second bolt end may or may not extend outside of the housing 12. For example, where a bore or other recess is provided in the housing 12, the second bolt end 34 may begin within the housing and move outside the housing when moving to the second position or may remain within the housing throughout its range of motion.

In some examples, the intermediate bolt body 38 is a region of bolt 30 extending between the first bolt end 32 and the second bolt end 34. In some examples, the intermediate bolt body 38 includes a proximal end and a distal end. In some examples, the intermediate bolt body 38 may include a generally circular outer surface having an outer diameter. In some examples, the outer diameter of the intermediate bolt body 38 is greater than the outer diameter of both the second bolt end 34 and the distal lip 18 of the first body 14. In some examples, a radially extending forward facing surface at the distal end of the intermediate bolt body 38 perpendicularly connects the outer surface of the second bolt end 34 and the outer surface of the intermediate bolt body 38. In some examples, wherein bolt 30 is longitudinally displaced in a distal direction, the forward-facing surface of the distal end of the intermediate bolt body 38 may contact a rear or proximal facing surface of the distal lip 18 of the first body 14 to arrest distal motion of the bolt 30. In some examples, the outer diameter of the intermediate bolt body 38 is less than the diameter of the bolt bore 19 of the first body 14. In some examples, the intermediate bolt body 38 includes a circumferential groove at its distal end. In some examples, a second radial seal 92 rests within the circumferential groove. In some examples, wherein the bolt 30 is longitudinally displaced such that the intermediate bolt body 38 is at least partially in contact with an inner surface of the bolt bore 19 of the first body 14, the second radial seal 92 contacts the inner surface of the bolt bore 19 to create an air seal. In such examples, the second radial seal 92 may prevent or resist gas from exiting the first body 14 between the bolt 30 and the inner surface of the bolt bore 19 of the first body 14.

With a particular focus on radial seals 90 and 92 arranged on the bolt 30, in some examples, there may only be one radial seal 90 positioned on the first bolt end 32. That is, in addition to radial seal 92, a single seal 90, rather than a double or triple seal 90, may be provided. In a further example, the only one radial seal 90 may be positioned just proximal of the second bolt lip 76. The second bolt lip 76 may help resist sliding of the radial seal 90 along the bolt 30. Only using a single radial seal 90 positioned on the first bolt end 32 may help to minimize or reduce friction between the bolt 30 and the housing assembly 12 compared to examples with multiple seals on the first bolt end 32. This reduction in friction may provide for a relatively smaller force to move the bolt 30 and may allow the bolt 30 to cycle between positions more quickly. Another benefit of using only one radial seal 90 on the first bolt end 32 is to help with the manufacturing process as well as cleaning the valve assembly 10. Some examples however may contain more than one radial seal 90 positioned on the first bolt end 32. In particular, two radial seals 90 may be provided as discussed above where the first bolt end 32 includes grooves adjacent the first and second bolt lips 72/76.

Radial seal 92 may prevent pressurized gas from leaking between the bolt 30 and the housing assembly 12 by the housing lip 18. In some examples, radial seal 90 positioned on the first bolt end 32 may have a larger surface area then a second radial seal 92 positioned on the intermediate bolt section 38. This may be accomplished by having radial seals with the same thickness but different diameters where, for example, the diameter of the radial seal 90 is larger than radial seal 92. Additionally, or alternatively, the radial seal 90 may have a larger thickness. This configuration may help to provide a balance of forces resulting from pressure in the expansion chamber 21 that biases the bolt 30 toward a first position discussed in more detail below.

The sealing member 80 may be configured to selectively fluidly seal or fluidly couple the orifice 50 and the back passage 23. The sealing member 80 may have the shape of an elongated or circular solid tube. Alternatively, the sealing member 80 may have the shape of an elongated rectangular tube or another cross-sectional shape may be provided. In any case, and as shown in FIG. 7, the sealing member 80 may have a cross-sectional size and shape that provides for covering and sealing the orifice 50. In some examples, the sealing member 80 may have a cross-sectional shape that matches that of the orifice 50 allowing for the sealing member to be inserted into the orifice 50 and seal when inserted. The sealing member 80 may have a length that is substantially similar to the primary passage or the orifice as a whole or the sealing member may have a length that is substantially shorter or longer than the orifice 50. The sealing member may be coupled to the actuator and be selectively positioned over the opening to the orifice 50, or inserted or removed from the orifice, by actuation of the actuator. The sealing member 80 may be coupled to any mechanism that is capable of selectively moving the sealing member between a first or sealing position and a second or unsealed position relative to the orifice. The sealing member 80 may be constructed of any material that is capable of fluidly sealing an opening, such as steel, plastic, rubber, or any other material known in the art which is capable of sealing. While an abutting seal or an internal cylindrical sealing member has been described, additionally or alternatively, a seal that both abuts the end of the nipple and has a portion that is inserted into the orifice may also be provided.

The actuator 82 may be configured to selectively position the sealing member 80 between a first sealing member position and a second sealing member position. The actuator can attach to the actuator interface 81 located on the proximal end of the intermediate body 16. When the actuator is a solenoid, the solenoid may generate a magnetic field that attracts the sealing member 80 to the solenoid, moving the sealing member 80 from the second sealing member position to the first sealing member position or vice versa. The actuator and sealing member 80 can be integrated into one solenoid valve unit. In other examples the actuator can be a mechanical link that physically connects the sealing member 80 to a trigger such that when the trigger is engaged, the mechanical link moves the sealing member 80 into the first sealing member position. When the trigger is released, the mechanical link moves the sealing member 80 to the second sealing member position. The actuator can attach to the actuator interface by a threaded connection. Additionally, or alternatively, the actuator can attach to the actuator interface via screws or bolts or by any other fastening means such as a quick lock or other system. The actuator 82 can be a solenoid, a valve, a mechanical assembly, a mechanical link from a trigger, button, or other user interface, an electrical link from a trigger, a push button, or any combination thereof.

In some examples the sealing member 80 may be a plunger coupled to a solenoid that is activated by a controller, an electrical signal from a trigger, a mechanical link from a trigger, or a button push. In some examples where the sealing member 80 is a plunger, the plunger may seal the orifice by sitting in the orifice 50 when the sealing member 80 is selectively positioned in the first sealing member position. In other examples, the sealing member 80 may not be in direct contact with the orifice 50. For example, this may be done by connecting a hose between the orifice 50 and the expansion chamber 21 with the sealing member 80 being selectively positioned between the first sealing member position and the second sealing member position wherein the sealing member 80 is not directly in contact with the orifice 50. In a further example, a solenoid may be removably coupled to the housing assembly 12 at least partially forming the expansion chamber 21. For example, the solenoid may be threaded to the housing assembly 12 sealing off the expansion chamber 20. In other examples, the solenoid may be attached by other means that are known in the art. In other examples, a solenoid valve, valve, mechanical assembly, a push button, or any combination thereof may be used to selectively position the sealing member 80 between the first sealing member position and the second sealing member position. Other ways to selectively position the sealing member 80 between the first sealing member position and the second sealing member position that are known in the art may be used.

The stem 60 may be configured to control the airflow through the longitudinal through-hole 36, within bolt 30, in conjunction with the sliding action of bolt 30 over the stem 60. The stem 60 may include an air-release cylinder 62 that has a centering disk 64 at the proximal base. The air-release cylinder 62 may include a solid cylindrical rod with a circular cross-section and a uniform diameter approximately sized to fit within the proximal end of the longitudinal through-hole 36, within bolt 30, in a sealing engagement with minimal friction. The air-release cylinder 62 may be long enough to completely seal the vent holes 40 within the bolt 30 when fully seated in the bolt bore 24 along pathway 102, but short enough to allow the vent holes 40 to be exposed on an internal side thereof when the bolt 30 has traversed to its most distal position along path 100 (e.g., the second bolt position). The air-release cylinder 62 may have an approximate length of 0.5 inches but other lengths may be provided and a length long enough to seal vent holes 40 when bolt 30 is fully seated against centering disk 64 may be provided. In addition, a length short enough to expose vent holes 40 when bolt 30 is distally extended along pathway 100 may also be provided. Air-release cylinder 62 may be made of a strong and durable material and may have a smooth and/or shiny surface.

Figure 9:
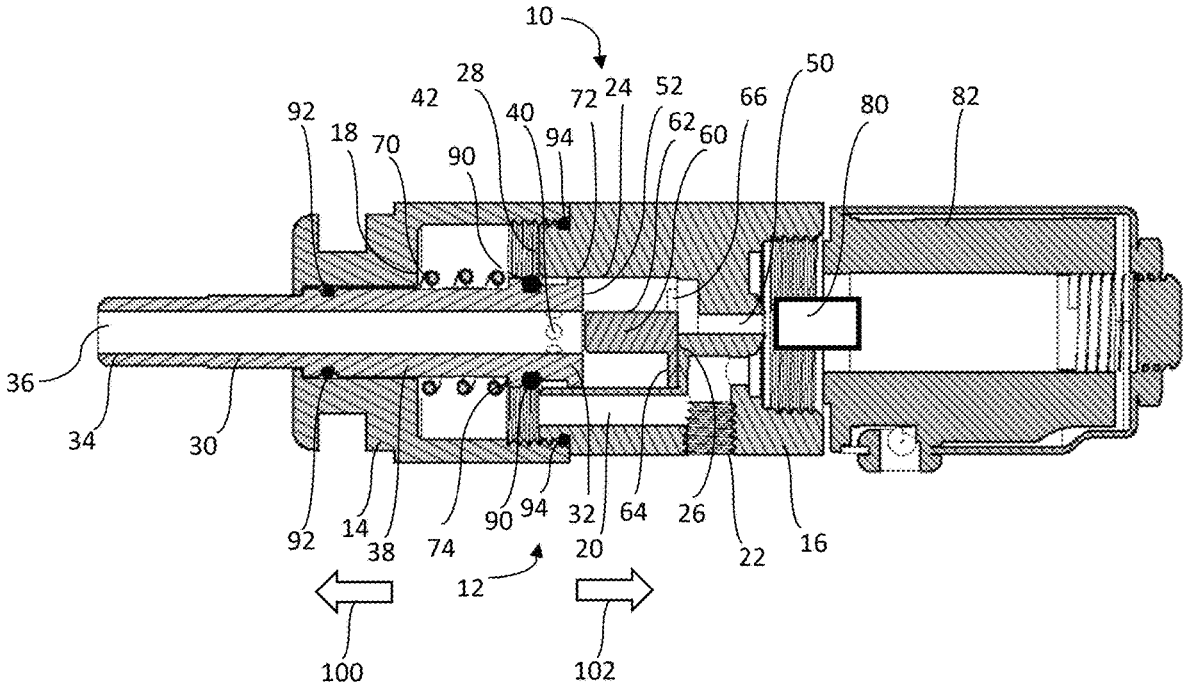
FIG. 9 is a cross-sectional right-side view of the valve assembly of FIG. 2 where the bolt is in a second position, the sealing member is in the second sealing member position, and the spring is in a compressed state.
Figure 10:
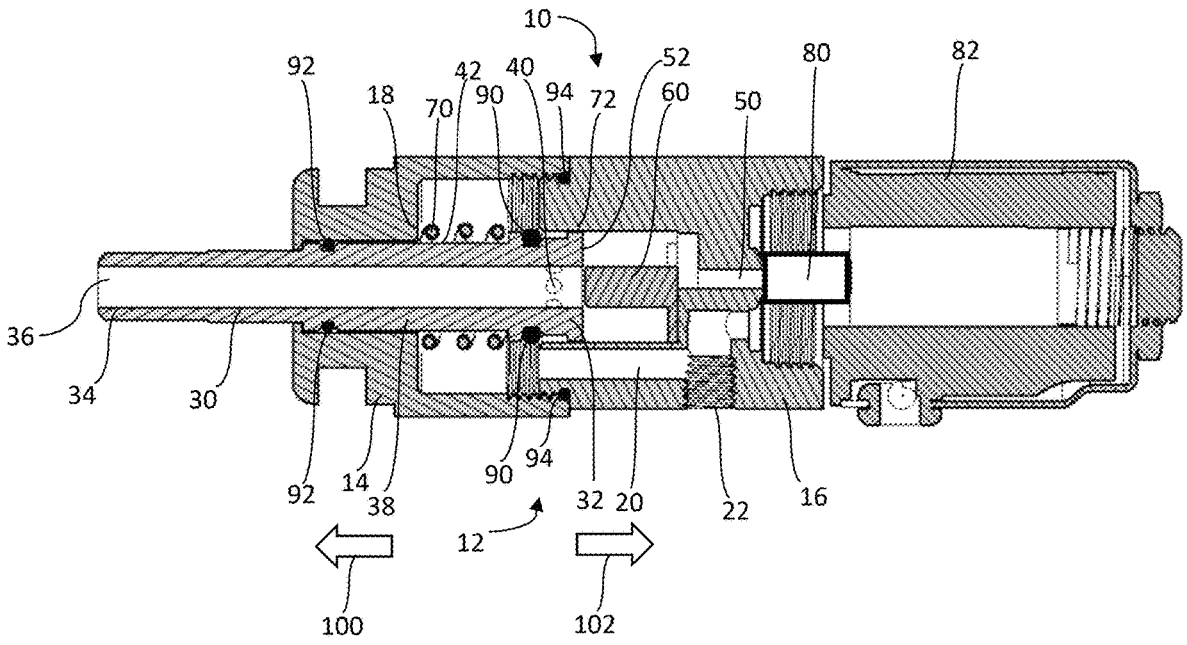
FIG. 10 is a cross-sectional right-side view of the valve assembly of FIG. 2 where the bolt is in the second position, the sealing member has returned to the first sealing member position, and the spring remains in a compressed state.
Figure 11:
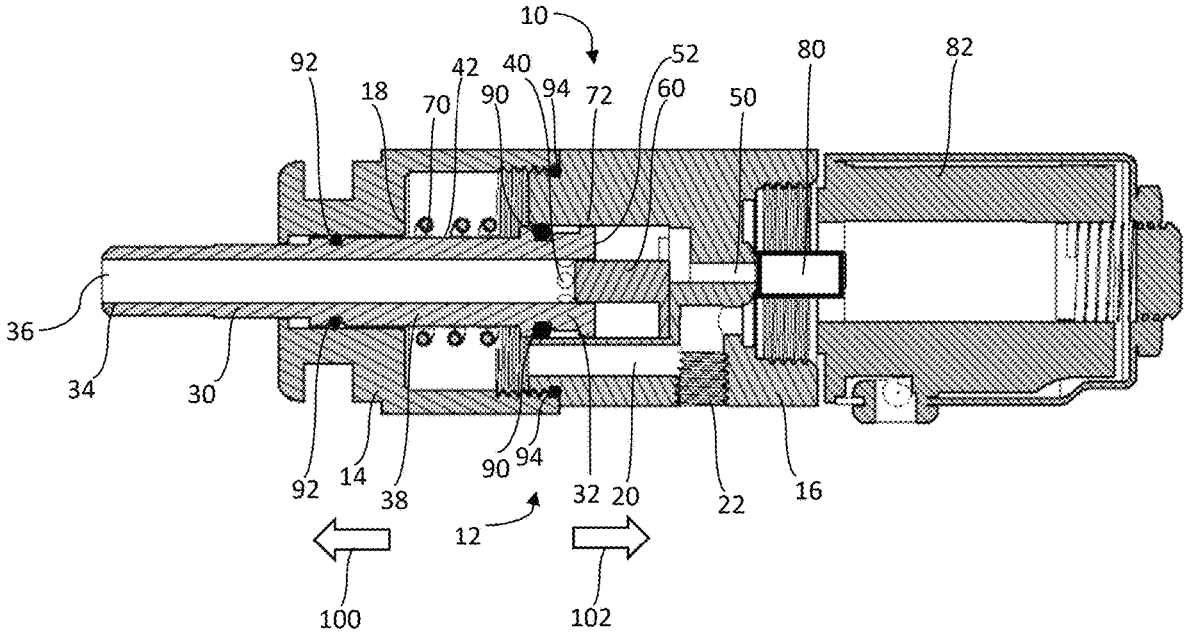
FIG. 11 is a cross-sectional right-side view of the valve assembly of FIG. 2 where the bolt is in a third position, the sealing member is in the first sealing member position, and the spring is in a less compressed state.

The centering disk 64 may comprise a thick, flat, circular disk attached or integrated with the proximal end of the air-release cylinder 62, forming a radially extended edge around the base. The diameter of centering disk 64 may approximately be equivalent to the diameter of central bore 24. The entirety of stem 60 may be arranged within central bore 24 and seated with the proximal surface of centering disk 64 in intimate contact with the distal facing bottom surface 26 of the central bore 24. The centering disk 64 may be made of the same or different material as the cylinder 62 and may have a similar finish. An opening in centering disk 64 may be provided that provides a fluid pathway 66 (see FIG. 9) from the radial passage 50B to the central bore 24. While the stem 60 including the air-release cylinder 62 and the centering disk 64 has been described as a separate part from the intermediate body 16, the stem 60 may be integral with the intermediate body. For example, and in the case of an integral stem, the fluid pathway 66 may be provided by drilling into an external face of the intermediate body 16. After machining, the portion of the opening not being used for pathway 66 may be plugged with, for example, a grub screw, sealant, screw/O-ring, weld metal, or other plugging device or system. Moreover, in one or more examples, the stem 60 may be adhered to the distally facing bottom planar surface 26 of the central bore 24. In one or more examples, the proximal face of the centering disk may include pins or dowels that extend into the bottom of the central bore 24 to assist with the adherence of the stem to the intermediate body.

Figure 8:
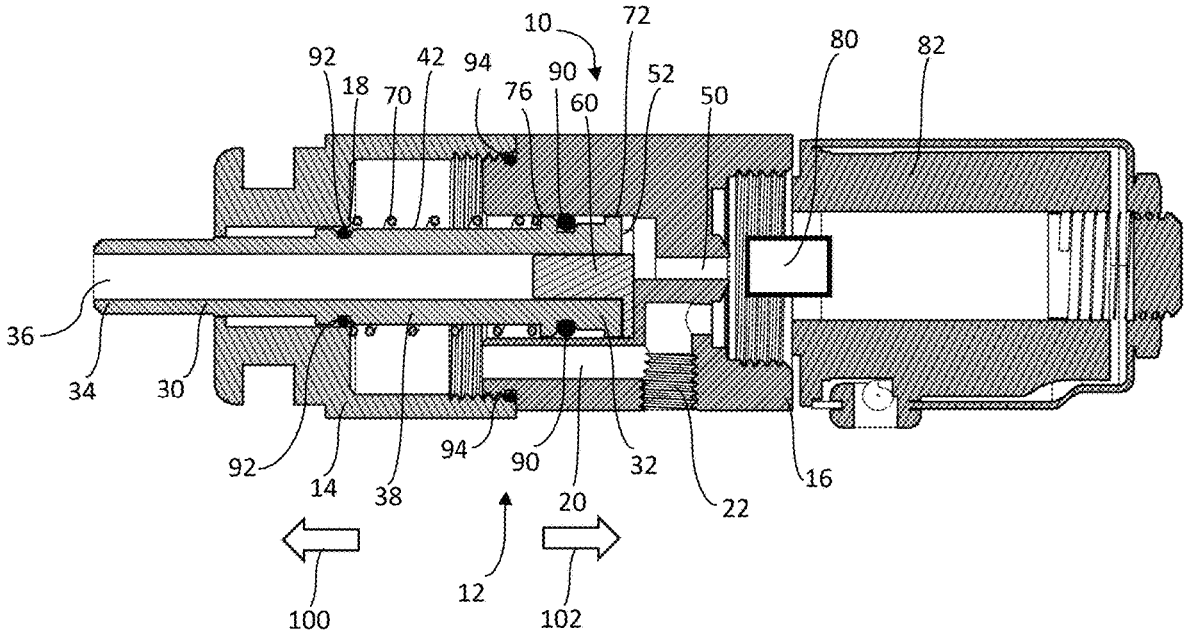
FIG. 8 is a cross-sectional right-side view of the valve assembly of FIG. 2 where the bolt is in the first position, the sealing member is in a second sealing member position, and the spring remains in a neutral state.

The valve assembly 10 may also include a spring 70. The spring 70 may be configured to at least partially assist the bolt 30 to translate from the second position to the third position and/or to the first position. The spring 70 may help reduce the time required to move the bolt 30 from the second position to the third position, thus, allowing the valve assembly 10 to be activated quickly. In some examples, the spring 70 may circumferentially surround the bolt 30. The spring 70 may bias the bolt 30 rearwardly relative to the housing when compressed. In some examples, the spring 70 may be placed elsewhere to assist the bolt 30 to translate from the second position to the third position. In some examples, the spring 70 may be in a neutral or non-compressed state when the bolt 30 is in the first position (e.g., as shown in FIGS. 7 and 8). This may help reduce or minimize the force needed to translate the bolt 30 from the first position to the second position. In a further example, when the spring 70 is in a neutral or non-compressed state when the bolt 30 is in the first position, the spring 70 may not be in contact with one or both of a housing assembly lip 18 or a second bolt lip 76. That is, while the spring 70 has been shown to have a length extending from the lip 18 to the bolt lip 76, a shorter spring may be provided. In some examples, as shown in FIGS. 7-11, the spring 70 may always be in contact with one or both the housing assembly lip 18 and a second bolt lip 76 when the bolt 30 is in the first position (shown in FIGS. 7 and 8). In such examples where the spring 70 is in contact with both the housing assembly lip 18 and the second bolt lip 76, a greater force may be needed to translate the bolt 30 from the first position to the second position to overcome the force of the spring 70 acting in a rearward direction 102 on the bolt 30.

With the several elements of the valve assembly 10 described, further discussion of these elements with particular attention to their operation or function may be provided. For example, and in short, the release of pressurized gas from the valve assembly 10 to propel a projectile may occur when the bolt 30 advances far enough forward that seal 90 exits the central bore 24 exposing the through holes 40 on the bolt 30 to the pressurized gas in the expansion chamber 21. That is, and more particularly, the valve assembly 10 may include an expansion chamber 21 positioned inside of the housing assembly 12. The expansion chamber 21 may be configured to receive a pressured gas from a pressurized gas source. In some examples, the expansion chamber 21 may receive the pressurized gas through the inlet or pressurized gas interface 22 and the auxiliary passage 20. In some examples, the expansion chamber 21 may receive the pressurized gas through other areas of the valve assembly 10.

The bolt 30 may be slidably positioned in at least part of the expansion chamber 21. For example, the bolt 30 may be movable from a first position (shown in FIGS. 7 and 8) to a second position (shown in FIGS. 9 and 10) relative to the housing assembly 12. The bolt 30 is also movable from the second position to a third position (shown in FIG. 11) relative to the housing assembly 12. The translation of the bolt 30 from the first position to the second position may fluidly couple radially disposed through hole or holes 40 with the expansion chamber 21. When the expansion chamber 21 is fluidly coupled with the at least one radially disposed through hole 40, a pressurized gas in the expansion chamber 21 may release through the radially disposed through hole or holes 40 and be released from the valve assembly 10 through the longitudinal through hole 36. This release of gas may function to propel a projectile. In some cases, the pressurized gas may also release from the expansion chamber 21 through the auxiliary passage 20, the back passage 23, and the orifice 50 to the first bolt end 32 in a proximal portion of the central bore 24 where it may release past the stem 60 directly into and through the longitudinal through hole 36. In some examples, the bolt 30 translating from the first position to the second position fluidly couples the at least one radially disposed through hole 40 with the expansion chamber 21 due to a radial seal 90, such as a distal most radial seal 90, no longer being in contact with an inner wall of the central bore 24. When this occurs, the pressurized gas inside of the expansion chamber 21 is able to flow around the radial seal 90, through the radially disposed through hole or holes 40, and through the longitudinal through hole 36 to ultimately exhaust through the longitudinal through hole 36 and be released from the valve assembly 10.

Several of the other elements of the valve assembly function to cause the bolt 30 to translate between the first position and the second position and back to the first position. In some examples, translating back to the first position occurs via translating to a third position. In any case, and initially, it is noted that the sealing member 80 may function to control whether gas flows through the orifice 50. That is, as shown when comparing FIGS. 7 and 8, the sealing member 80 may include a first sealing member position (shown in FIG. 7) sealing the orifice 50 from the expansion chamber 21 and a second sealing member position (shown in FIG. 8) fluidly coupling the orifice 50 and the expansion chamber 21. The sealing member 80 may be moved between the first/second sealing member positions by the actuator 82. The orifice 50, when not sealed by the sealing member 80, is configured to allow the passage of gas from the expansion chamber 21 to the first bolt surface 52. That is, when the sealing member is removed from the orifice 50, pressurized gas may flow from the expansion chamber 21 into the orifice 50 via the auxiliary passage 20, the bore of the pressurized gas interface 22, and the back passage 23. However, while this may allow gas to enter the proximal portion of the central bore 24, the gas might not readily flow through the through holes 40 of the bolt 30 because of the presence of the stem 60 extending into the proximal portion of the bolt 30 and sealing off the through holes 40.

As shown in FIGS. 7 and 8, the air-release cylinder 62 of the stem 60 may extend within the longitudinal through hole 36 when the bolt 30 is in the first position. In some examples, the stem 60 may seal the longitudinal through hole 36 when the bolt 30 is in the first position. In other examples, the stem 60 may not completely seal the longitudinal through hole 36 allowing a gas to pass between the stem 60 and the bolt 30 through the longitudinal through hole 36. This may occur when the gas passes from the expansion chamber 21 through the orifice 50. In some examples, the stem 60 may seal the longitudinal through hole 36 and the at least one radially disposed through hole 40 preventing the gas to pass through either or both the longitudinal through hole 36 or the at least one radially disposed through hole 40 when the bolt 30 is in the first position. In some examples, the stem 60 may partially seal the longitudinal through hole 36 and at least one radially disposed through hole 40. In such examples, the passage of gas from the orifice 50 may leak between either or both the stem 60 and the bolt 30 through the longitudinal through hole 36 or between the at least one radially disposed through hole 40 and the stem 60. In such examples, the leak of gas may be relatively minimal due to the gap between the stem 60 and bolt 30 as the stem 60 at least sits partially in the longitudinal through hole 36. The stem 60 may decrease the area that the gas may pass through for either or both the longitudinal through hole 36 or the at least one radially disposed through hole 40. When this occurs, there may still be a pressure acting on the first bolt surface 52 creating a force in the forward direction 100 when pressurized gas is introduced through the orifice 50.

The translation of the bolt 30 from the first position to the second position occurs when the forces acting on the bolt 30 in a forward direction 100 are greater than the forces acting on the bolt 30 in the rearward direction 102. That is, when the bolt 30 is in the first position, or between the first position and the second position for that matter, forces acting on the bolt in a forward direction that exceed rearwardly directed forces will cause the bolt to move from the first position to the second position. The forces acting on the bolt 30 in the rearward direction 102 include the force from gas pressure in the expansion chamber 21 acting on radial seal 90. Moreover, as the bolt moves from the first position to the second position, frictional forces between the radial seals 90 and 92 and the housing assembly 12 may resist the motion and may act in a rearward direction as the bolt translates in the forward direction. In addition, where the spring 70 includes a preload, for example, and is somewhat compressed when the bolt is in the first position, the spring 70 may act on the bolt 30 in the rearward direction 102. However, when the spring 70 is not in a compressed state, the spring 70 does not create a force acting on the bolt 30 in the rearward direction 102. It is to be appreciated that as the bolt moves, the spring 70 may become compressed and, as such, the force from the spring 70 acting on the bolt 30 may vary as the bolt 30 translates (e.g., the rearward force on from the spring 70 may increase based on a spring constant, for example.) The forces acting on the bolt 30 in the forward direction 100 include the force from the gas pressure in the expansion chamber 21 acting on radial seal 92 and, when the orifice 50 is open, the force from gas pressure acting on the first bolt surface 52. That is, as to the latter force, the force acting on the first bolt surface 52 from the gas pressure via the orifice 50 occurs when the sealing member 80 is selectively positioned from the first sealing member position (shown in FIG. 7) to the second sealing member position (shown in FIG. 8).

When the gas is allowed to pass through the orifice 50 the pressure acting against the first bolt surface 52 is the same pressure that is in the expansion chamber 21 acting on the radial seals 90 and 92. Moreover, the surface area of the first bolt surface 52 may be greater than the difference between the surface areas of the radial seal 90 and the radial seal 92. That is, as was mentioned earlier, the surface area of the seal 90 may exceed the surface area of the seal 92 and, as such, without more, the bolt may be biased in a rearward direction when pressure is exerted on only the expansion chamber-side of the seals. However, when the orifice is open, gas pressure from the chamber extends around to a rear side of the bolt 30 and can act on the first bolt surface 52 and/or the rear/proximal face of the seal 90. This surface area is larger than the surface area of the seal 92 alone and, as such, offsets the rearward pressure on the seal 90. When the forward force on the bolt 30 is combined with the forward force on the seal 92, the bolt may be caused to translate in a forward direction. These surface areas and pressures may be selected to also exceed any rearward force from the spring and any resistance to motion from friction of the seals on the housing assembly 12.

Accordingly, in operation, the sealing member 80 may be selectively positioned from the first sealing member position to the second sealing member position using the actuator 82. This may fluidly couple the expansion chamber 21 and the orifice 50 exposing the first bolt surface 52 to the gas pressure in the expansion chamber 21. As the bolt 30 translates from the first position to the second position, the seal 90, or at least the most distal seal 90 (e.g., if there are 2), may pass out of the central bore 24 allowing gas to flow around the seal 90 to the radially disposed through hole or holes 40 on the main body 88 of the bolt 30. The pressurized gas from the expansion chamber 21 may, thus, escape through the radially disposed through hole or holes 40 and out of the distal end of the longitudinal through hole 36. In addition, gas may more directly enter the proximal end of the longitudinal through hole 36 further contributing to the gas flow through the bolt 30 and out of the distal end of the longitudinal through hole 36.

Prior to discussing translation of the bolt 30 from the second position to the third position, it may be helpful to appreciate that, in some examples, the expansion chamber 21 may always be pressurized. In other words, the expansion chamber 21 may be constantly fluidly coupled to the pressurized gas source as shown in FIGS. 7-11. However, in some examples, the expansion chamber 21 may not always be fluidly coupled to the pressurized gas source. This may be accomplished by using a valve, such as a two-position three-way valve, which may be selectively positioned to control the pressurized gas entering the expansion chamber 21 via the pressurized gas interface 22. In some configurations, this valve may also include the sealing member 80.

Figure 12A:
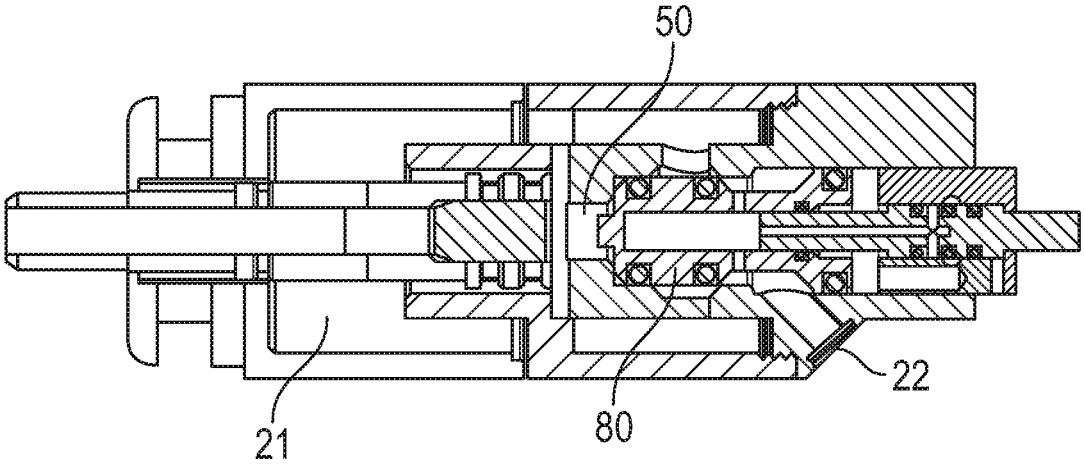
FIG. 12A is a cross-sectional view of a valve assembly and actuator, according to one or more examples.
Figure 12B:
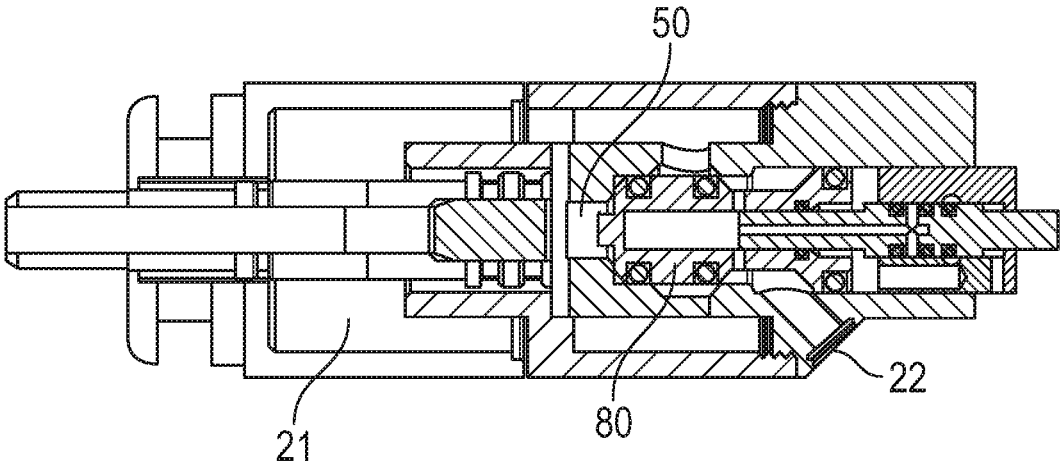
FIG. 12B is a cross-sectional view of the valve assembly and actuator of FIG. 12A with an actuator button being pressed.
Figure 12C:
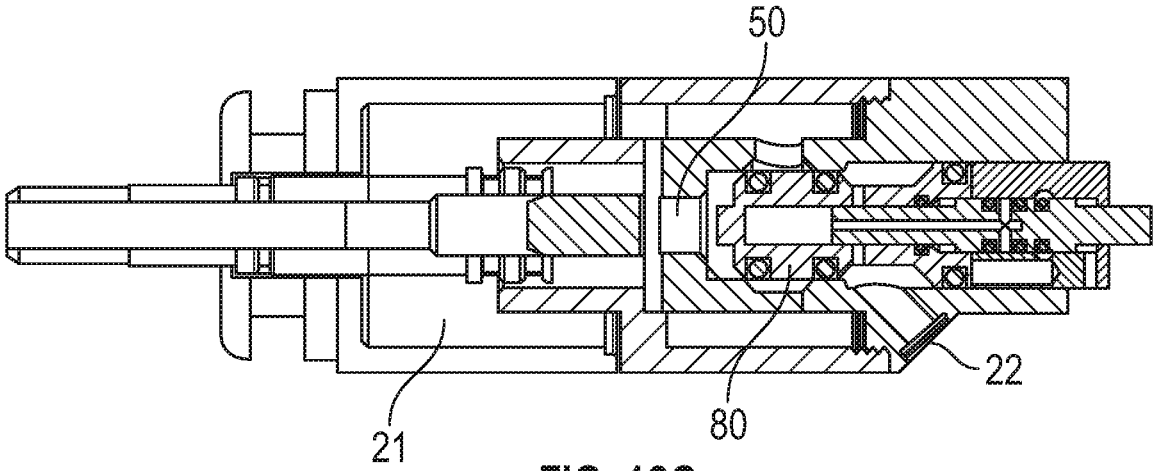
FIG. 12C is a cross-sectional view of the valve assembly of FIG. 12A with the actuator button remaining pressed and a sealing member retracted.

That is, as shown as an example in FIGS. 12A-12C, a particular arrangement of the fluid pathways of the valve assembly may include an orifice 50 arranged between the pressurized gas interface 22 and the expansion chamber 21 where actuation of the sealing member 80 to expose the gas chamber 21 to the orifice 50 may seal off gas flow from the gas source. When the sealing member 80 is unactuated, the gas from the gas source may bypass the orifice 50 and flow to the gas chamber 21 to recharge the gas chamber 21 for example. Accordingly, as shown in FIGS. 12A and 12B, when the sealing member 80 is selectively positioned in the first sealing member position, the pressurized gas source may be fluidly coupled to the expansion chamber 21. However, as shown in FIG. 12C, when the sealing member 80 is selectively positioned from the first sealing member position to the second sealing member position, the pressurized gas source may no longer be fluidly coupled to the expansion chamber 21. Other examples may use an additional valve, such as a two-position two-way valve, to fluidly couple and seal the expansion chamber 20 from the pressurized gas source and may not be the sealing member 80.

With this in mind, the translation of the bolt 30 from the second to the third position may occur when the forces acting on the bolt 30 in the rearward direction 102 are greater than the forces acting on the bolt 30 in the forward direction 100. For example, when the bolt 30 has translated to the second position, the sealing member 80 may still be in the second sealing member position (shown in FIG. 9). However, once the sealing member 80 is selectively positioned back to the first sealing member position (shown in FIG. 10), the orifice 50 is then sealed and the passage of gas from the expansion chamber 21 through the orifice 50 is no longer acting against the first bolt surface 52 or the rearward surface of the seal 90. The spring 70, however, may be in a compressed state at least partially assisting in the translation of the bolt 30 from the second position to the third position. That is, the spring 70 being in a compressed state will cause a force acting on the bolt 30 in the rearward direction 102. More particularly, in some examples the spring 70 may be compressed between the housing assembly lip 18 and the second bolt lip 76 when the bolt 30 is in the second position.

In view of this, the forces acting on the bolt 30 in the rearward direction 102 when the bolt 30 is in the second position and the sealing member is back in its first sealing member position may include the force from gas in the expansion chamber 21 acting on radial seal 90 and the force from the compressed spring 70. It is noted that there may be a time when the bolt 30 in translating from the second position to the third position where a force is applied to the bolt 30 from the spring 70 when the bolt 30 was in the second position and that force is no longer present when the bolt 30 is in the third position. An example of such time would be when the spring 70 is compressed when the bolt 30 is in the second position but not compressed when the bolt 30 reaches the third position. While radial seal 90 is not in contact with the housing assembly 12 when the bolt 30 is in the second position, the area between radial seal 90 and the housing assembly 12 may be small enough where pressure inside the expansion chamber 21 may not reach the same pressure as present outside of the valve assembly 10. Because there is still a pressure that is greater than pressure outside of the valve assembly 10, gas flow past radial seal 90 may provide a force created on radial seal 90 that is in the rearward direction 102. In any case, the force from the spring 70 may urge the bolt rearward to reengage the seal 90 with the central bore 24 whereafter the rearward force on the seal may more fully develop as discussed in more detail below. The forces acting on the bolt 30 in the forward direction 100 when the bolt 30 is in the second position and the sealing member is back to its first position may include the force from the gas in the expansion chamber 21 acting on radial seal 92. In addition, as the bolt translates to the third position, frictional force between the housing assembly 12 and the radial seal 92 may resist the rearward motion and may be considered to act in the forward direction.

In some examples, the bolt 30 may translate from the third position (shown in FIG. 11) back to the first position (shown in FIGS. 7 and 8). That is, after reaching the third position and with the sealing member 80 remaining in the first sealing member position, the translation of the bolt 30 from the third position to the first position occurs when the forces acting on the bolt 30 in the rearward direction 102 are greater than the forces acting on the bolt 30 in the forward direction 100. Here, the forces acting on the bolt 30 in the rearward direction 102 when the bolt 30 is in the third position include forces from gas pressure in the expansion chamber 21 acting on radial seal 90. In some examples there may be a force from the spring 70. Such force may be present, for example, if the spring 70 remains in a compressed state when the bolt 30 is in the third position. However, there may be a time when the bolt 30 in translating from the third position to the first position and a force applied to the bolt 30 from the spring 70 when the bolt 30 was in the third position is no longer present when the bolt 30 is in the first position. An example of this is when the spring 70 is compressed when the bolt 30 is in the third position but not compressed when the bolt 30 reaches the first position. The forces acting on the bolt 30 in the forward direction 100 when the bolt 30 is in the third position include the force from the gas in the expansion chamber 21 acting on radial seal 92. In addition, as the bolt translates from the third position to the first position, the frictional forces between the housing assembly 12 and the radial seals 90 and 92 may resist the rearward motion and may be considered to act in the forward direction.

In some examples, there may be an additional force acting in the forward direction 100 from the pressure that is built up between the first bolt surface 52 and orifice 50. In some examples, that additional force of the pressure built up between the first bolt surface 52 and the orifice 50 may not exist as the pressure from the gas may be exhausted through either or both the gap between the stem 60 and bolt 30. This would occur when the stem 60 does not completely seal either or both the longitudinal through hole 36 or the at least one radially disposed through hole 40. In some further examples, the force that is acting on the bolt 30 from the pressure that is built up between the first bolt surface 52 and the orifice 50 may not be exhausted from the valve assembly 10. In such examples, the forces acting on the bolt 30 in the rearward direction 102 may need to be greater to allow the bolt 30 to translate from the third position to the first position. These increased rearward forces may be provided by increasing the pressure of the gas inside of the expansion chamber 21. The increased force may also be provided by sizing the spring 70 to be in a compressed state when the bolt 30 is in the first position.

At times, the valve assembly 10 may need to be disassembled for cleaning or replacing components. Reducing the number of radial seals throughout the whole valve assembly 10 allows for a faster and easier clean as there are less components. Additionally, allowing access to the sealing member 80 makes the cleaning process more efficient. For example, in an example with the sealing member 80 that is selectively positioned between the first sealing member position and the second sealing member position with a solenoid 82, being able to remove the solenoid 82 from the housing assembly 12 allows for access to sealing member 80 and orifice 50 where they may be cleaned to increase the efficiency of flow rate of the gas.

It is to be appreciated that while the present valve assembly 10 has been described in the context of airsoft guns, the valve assembly may have much broader applicability. For example, the valve assembly could be used for any application that involving a compressed gas supply that is repeatedly attached, pressurized, and disconnected. For example, on an assembly line, the valve assembly could be used for pressurizing canisters, rapidly drying internal or external surfaces of parts, or removing defective parts from a conveyor belt. The present valve assembly may be useful as compared to a regular compressed air nozzle because the present valve assembly has the built in ability to move into position when producing an air jet and to get out of the way of the next part on the assembly line after producing the air jet. For example, when an air nozzle may not be permanently mounted in its air supply position because of interference with other activities, the present assembly would be helpful. In addition, the bolt or pressure chamber could be connected to oil, grease, water, steam, food ingredients, etc. in order to apply a mist/aerosolized version of the additive to whatever is being sprayed. Alternatively, or additionally, the compress gas source would be mixed with such oil, grease, water, steam, food, etc. In addition, the distal end of the bolt could be fitted with a spray nozzle or other geometry to achieve the desired effects. Moreover, the loading force can be increased/decreased depending on the application and the length of stroke can be increased/decreased depending on the clearance desired.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112 (f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A valve assembly, comprising:

a housing assembly;

an expansion chamber configured to receive a pressurized gas source and positioned inside of the housing assembly;

a bolt with a first bolt end and a second bolt end, wherein the bolt is slidably positioned in at least part of the expansion chamber and movable from a first position to a second position relative to the housing assembly, the bolt also movable from the second position to a third position relative to the housing assembly, the bolt having a longitudinal through hole from the first bolt end to the second bolt end;

at least one radially disposed through hole extending from a radially outer bolt surface to the longitudinal through hole, wherein the translation of the bolt relative to the housing assembly from the first position to the second position fluidly couples the expansion chamber with the at least one radially disposed through hole, wherein the translation of the bolt relative to the housing assembly from the second position to the third position fluidly seals the expansion chamber from the at least one radially disposed through hole;

an orifice configured to allow a passage of a gas from the expansion chamber to a first bolt surface;

a stem coupled to the housing assembly, wherein the stem is configured to at least partially sit within the longitudinal through hole of the bolt when the bolt is in the first position; and a sealing member, wherein the sealing member is configured to seal the expansion chamber from the orifice, the sealing member having a first sealing member position sealing the orifice from the expansion chamber, the sealing member having a second sealing member position fluidly coupling the orifice and the expansion chamber.

2. The valve assembly of claim 1 further comprising a spring to at least partially assist the movement of the bolt from the second position to the third position.

3. The valve assembly of claim 2, wherein the spring circumferentially surrounds the bolt.

4. The valve assembly of claim 2, wherein the spring is in a neutral state when the bolt is in the first position.

5. The valve assembly of claim 4, wherein the spring is not in contact with one or both a housing assembly lip or a first bolt lip when the bolt is in the first position.

6. The valve assembly of claim 1, wherein the bolt further comprises only one radial seal positioned between the first bolt end and an intermediate bolt section.

7. The valve assembly of claim 6, wherein the bolt comprises a first bolt lip and a second bolt lip wherein the one radial seal is positioned along the second bolt lip.

8. The valve assembly of claim 1, further comprising no more than two radial seals positioned on the radially outer bolt surface.

9. The valve assembly of claim 8, wherein at least one of the radial seals is positioned between the first bolt end and an intermediate bolt section.

10. The valve assembly for a projectile launching system of claim 1, wherein the housing assembly comprises a first body and an intermediate body removably coupled to the first body, wherein the expansion chamber is at least partially defined by the first body and the intermediate body.

11. The valve assembly for a projectile launching system of claim 1, wherein the sealing member is selectively positioned between the first sealing member position and the second sealing member position with a solenoid.

12. The valve assembly for a projectile launching system of claim 11, wherein the solenoid is removably coupled to the housing assembly at least partially forming the expansion chamber.

13. A valve assembly, comprising:

a housing assembly defining an expansion chamber therein configured to receive a pressurized gas source and defining a central bore, the expansion chamber having a distal portion distal of the central bore and a proximal portion proximal of the central bore;

a bolt with a first bolt end, a second bolt end and an intermediate bolt body arranged therebetween, the first bolt end comprising a main body defining a first bolt surface and having a radially outer bolt surface, wherein the bolt is slidably positioned in at least part of the expansion chamber and movable from a first position to a second position relative to the housing assembly, the bolt having a longitudinal through hole extending from the first bolt end to the second bolt end, the bolt having a first bolt lip at the first bolt end and a second bolt lip distal of the first bolt lip and a circumferential groove immediately proximal to the second bolt lip, wherein a seal is arranged in the circumferential groove and is configured to contact an inner surface of the central bore when arranged therein;

a spring arranged on the intermediate bolt body and engaging the second bolt lip at a proximal end thereof and a distal surface of distal portion of the expansion chamber at a distal end thereof;

at least one radially disposed through hole extending from the radially outer bolt surface to the longitudinal through hole and arranged between the first bolt lip and the second bolt lip, wherein the translation of the bolt relative to the housing assembly from the first position to the second position fluidly couples the expansion chamber with the at least one radially disposed through hole;

an orifice configured to allow a passage of a gas from the proximal portion of the expansion chamber to the first bolt surface to advance the bolt along the central bore;

a stem coupled to the housing assembly, wherein the stem is configured to at least partially sit within the longitudinal through hole of the bolt when the bolt is in the first position; and a sealing member having a first sealing member position sealing the orifice from the proximal portion of the expansion chamber and a second sealing member position fluidly coupling the orifice and the proximal portion of the expansion chamber, wherein, when the sealing member is in the second position, gas passes through the orifice to act on the first bolt surface to advance the bolt along the central bore and when the seal arranged in the circumferential groove moves out of the central bore, gas from the distal portion of the expansion chamber passes proximally of the seal and to and through the plurality of radially disposed through holes and distally through the bolt.

14. The valve assembly of claim 13, wherein the spring is in a neutral state when the bolt is in the first position.

15. The valve assembly of claim 14, wherein the spring is not in contact with one or both a housing assembly lip or a first bolt lip when the bolt is in the first position.

16. A valve assembly, comprising:

a housing defining an expansion chamber and having a central bore at a proximal end for receiving a first end of a bolt and a bolt bore at a distal end for receiving a second end of the bolt, the housing defining an orifice arranged at a proximal end of the central bore and providing fluid communication between a proximal portion of the central bore and the expansion chamber;

the bolt arranged in the housing and configured to articulate within the central bore and the bolt bore from a first position to a second position, the bolt comprising:

a longitudinal through hole extending throughout a length thereof;

a first seal arranged on the first end and configured for sealingly engaging the central bore;

a second seal arranged on the second end and configured for sealingly engaging the bolt bore; and a plurality of radially disposed through holes extending therethrough to the longitudinal through hole within the bolt; and a seal configured to selectively seal the orifice.

17. The valve assembly of claim 16, wherein the first seal defines a first annular area and the second seal defines a second annular area and the first annular area is larger than the second annular area.

18. The valve assembly of claim 17, wherein, when the bolt is in the second position, the first seal is arranged outside of the central bore providing direct fluid communication between the expansion chamber and the central bore.

19. The valve assembly of claim 16, wherein the plurality of radially disposed through holes are proximal of the first seal.

* * * * *